US010685797B2

(12) United States Patent
Hartmann et al.

(10) Patent No.: US 10,685,797 B2
(45) Date of Patent: Jun. 16, 2020

(54) INSULATOR ARRANGEMENT FOR A HIGH-VOLTAGE OR MEDIUM-VOLTAGE SWITCHGEAR ASSEMBLY

(71) Applicants: Siemens Aktiengesellschaft, Munich (DE); Angelika Hartmann

(72) Inventors: Werner Hartmann, Weisendorf (DE); Steffen Lang, Hallerndorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/324,263

(22) PCT Filed: Jul. 18, 2017

(86) PCT No.: PCT/EP2017/068073
§ 371 (c)(1),
(2) Date: Feb. 8, 2019

(87) PCT Pub. No.: WO2018/028946
PCT Pub. Date: Feb. 15, 2018

(65) Prior Publication Data

US 2019/0164708 A1 May 30, 2019

(30) Foreign Application Priority Data

Aug. 9, 2016 (DE) ..... 10 2016 214 752

(51) Int. Cl.
*H01H 33/662* (2006.01)

(52) U.S. Cl.
CPC ..... *H01H 33/66261* (2013.01); *H01H 33/66207* (2013.01); *H01H 2033/66276* (2013.01); *H01H 2033/66284* (2013.01)

(58) Field of Classification Search
CPC ..... H01H 33/66261; H01H 33/66207; H01H 2033/6623; H01H 2033/66284;
(Continued)

(56) References Cited

U.S. PATENT DOCUMENTS 1,902,473 A * 3/1933 Ungelenk ..... H01J 5/06 313/239
4,618,749 A 10/1986 Böhme et al. ..... 218/134
(Continued)

FOREIGN PATENT DOCUMENTS

CN 2439099 Y 7/2001 ..... H01H 33/662
DE 41 25 097 A1 2/1992 ..... H01H 33/662
(Continued)

OTHER PUBLICATIONS

Translation JP2004265801 (Original document published Sep. 24, 2004) (Year: 2004).*
(Continued)

*Primary Examiner* — William A Bolton
(74) *Attorney, Agent, or Firm* — Slayden Grubert Beard PLLC

(57) ABSTRACT

Various embodiments may include an insulator arrangement for a switchgear assembly comprising: an axially symmetrical insulating structure element; a first conductive annular structure arranged on an inner surface of the structure element; and a second conductive annular structure arranged on an outer surface of the structure element. The first annular structure and the second annular structure are insulated from one another by the insulating structure element.

20 Claims, 3 Drawing Sheets

(58) Field of Classification Search
CPC ..... H01H 2033/66292; H01H 33/24; H01H 33/53; H01B 19/00; H01B 3/12
USPC ..... 218/136, 134, 139, 155
See application file for complete search history.

(56) References Cited

U.S. PATENT DOCUMENTS

| | | | | |
|---|---|---|---|---|
| 5,189,270 | A | 2/1993 | Matumoto et al. | 218/130 |
| 6,649,856 | B2 * | 11/2003 | Makino | H01B 17/50 218/118 |
| 7,285,743 | B2 * | 10/2007 | Martin | H01H 33/027 218/136 |
| 9,123,490 | B2 * | 9/2015 | Baron | H01H 33/66261 |
| 2009/0173719 | A1 * | 7/2009 | Kobayashi | H01H 33/6606 218/140 |
| 2013/0244022 | A1 * | 9/2013 | Rueger | C09D 5/24 428/324 |
| 2019/0164708 | A1 | 5/2019 | Hartmann et al. | |

FOREIGN PATENT DOCUMENTS

| | | | | |
|---|---|---|---|---|
| DE | 699 18 156 T2 | | 8/2005 | H01H 33/662 |
| DE | 10 2007 022 875 A1 | | 11/2008 | H01H 33/662 |
| EP | 0 176 665 A2 | | 4/1986 | H01H 33/66 |
| EP | 1 124 242 A1 | | 8/2001 | H01H 33/662 |
| EP | 1 249 850 A2 | | 10/2002 | H01H 33/24 |
| JP | S48-44309 B1 | | 12/1973 | H01H 33/66 |
| JP | 2004265801 | * | 9/2004 | H01H 33/66 |
| JP | 2010-073459 A | | 4/2010 | H01H 33/66 |
| WO | 2010/000769 A1 | | 1/2010 | H01H 33/66 |
| WO | 2018/028946 A1 | | 2/2018 | H01H 33/662 |

OTHER PUBLICATIONS

WO 2018/028946 A1, US 2019/0164708 A1.
DE 699 18 156 T2, EP 1 124 242 A1.
EP 0 176 665 A2, U.S. Pat. No. 4,618,749 A.
DE 41 25 097 A1, U.S. Pat. No. 5,189,270 A.
German Office Action, Application No. 10 2016 214 752.8, 9 pages, dated Jul. 3, 2017.
International Search Report and Written Opinion, Application No. PCT/EP2017/068073, 23 pages, dated Nov. 7, 2017.
Chinese Office Action, Application No. 201780057245.X, 10 pages, dated Aug. 23, 2019.

* cited by examiner

INSULATOR ARRANGEMENT FOR A HIGH-VOLTAGE OR MEDIUM-VOLTAGE SWITCHGEAR ASSEMBLY

CROSS-REFERENCE TO RELATED APPLICATIONS

This application is a U.S. National Stage Application of International Application No. PCT/EP2017/068073 filed Jul. 18, 2017, which designates the United States of America, and claims priority to DE Application No. 10 2016 214 752.8 filed Aug. 9, 2016, the contents of which are hereby incorporated by reference in their entirety.

TECHNICAL FIELD

The present disclosure relates to insulation. Various embodiments may include a method for producing a ceramic insulator.

BACKGROUND

The insulating capability of solids such as, for example, aluminum oxide ceramics, in relation to high-voltage loads is generally very high but is limited by the finite dielectric strength of solids. This also applies to high-voltage insulators, in particular ceramic insulators for medium-voltage and high-voltage vacuum interrupters. The reason therefor is the buildup of discharge within insulators, which is conjointly determined by the defect density in the direction of the field. In this case, the dielectric strength, the breakdown field strength, in the solid does not scale directly with the insulator length but is proportional to the square root of the insulator length. This has the result that, in particular for high voltages above approximately 100 kV, it becomes increasingly difficult to attain the required proof voltage of, for example, vacuum interrupters for the high-voltage sector, that is to say in a range of more than 72 kV.

To date, this problem, in particular in the case of vacuum interrupters in power transmission and distribution technology, has been solved in that a plurality of comparatively short components are used instead of a single cylindrical insulator component having a relatively large length, said plurality of comparatively short components being connected to one another in the axial direction by a suitable, vacuum-tight and mechanically stable connection technology such as, for example, a brazing solder. According to the physical laws of the internal proof voltage described above, the combination of a plurality of such comparatively short insulators has a higher proof voltage than an integral insulator of the same length. However, this solder method overall is very cost-intensive since a high technical complexity is required in order for the corresponding vacuum tightness to be generated for the connection.

SUMMARY

The teachings of the present disclosure describe a ceramic insulator for a high-voltage or medium-voltage switchgear assembly that is producible in a cost-effective manner in technical terms. For example, some embodiments may include an insulator arrangement (2) for a high-voltage or medium-voltage switchgear assembly having at least one axially symmetrical insulating structure element (4), characterized in that the structure element (4) has a conductive annular structure (8) arranged on the inner surface (6) thereof and a conductive annular structure (14) arranged on the outer surface thereof, said annular structures being insulated from one another by the insulating structure element.

In some embodiments, the annular structure (8) has an electrical conductivity that is at least eight powers of ten higher than the conductivity of the adjoining surface of the structure element.

In some embodiments, the annular structure (8) has an axial extent (10) that is at least half the thickness and at most four times the thickness of the structure element (4) in the radial direction.

In some embodiments, the outer and the inner annular structure (16) are mounted with respect to one another in such a way that they have an overlap with respect to a perpendicular (18) on the longitudinal axis (20) of the structure element (4).

In some embodiments, at least two structure elements (4, 4') are provided, which are joined to one another along their end faces, wherein each of the at least two structure elements (4, 4') has at least one annular structure (8, 16).

In some embodiments, the structure element (4, 4') has an axial extent between 10 mm and 200 mm, between 20 mm and 80 mm, or even between 20 mm and 40 mm.

In some embodiments, the distance between the annular structures (8, 16) in the axial direction is between 5 mm and 40 mm.

In some embodiments, a further coating of the structure element is provided on the inner side thereof and/or the outer side thereof, said coating having a sheet resistance between $10^8$ ohms and $10^{12}$ ohms, or between $10^8$ ohms and $10^{10}$ ohms.

In some embodiments, the annular structure (8, 16) is in the form of a metallic structure, in particular is designed in the form of a ring or in the form of a strip.

In some embodiments, the annular structure (8, 16) is attached in the form of a conductive coating.

As another example, some embodiments include a vacuum interrupter for high-voltage or medium-voltage applications, comprising an insulator arrangement as described above.

BRIEF DESCRIPTION OF THE DRAWINGS

Example embodiments and features of the teachings herein are explained in more detail with reference to the following figures. Features with the same designation but in different embodiments are provided with the same reference symbols in this case. The embodiments are purely exemplary embodiments that do not limit the scope of disclosure.

In the drawings.

DETAILED DESCRIPTION

Figure 1:
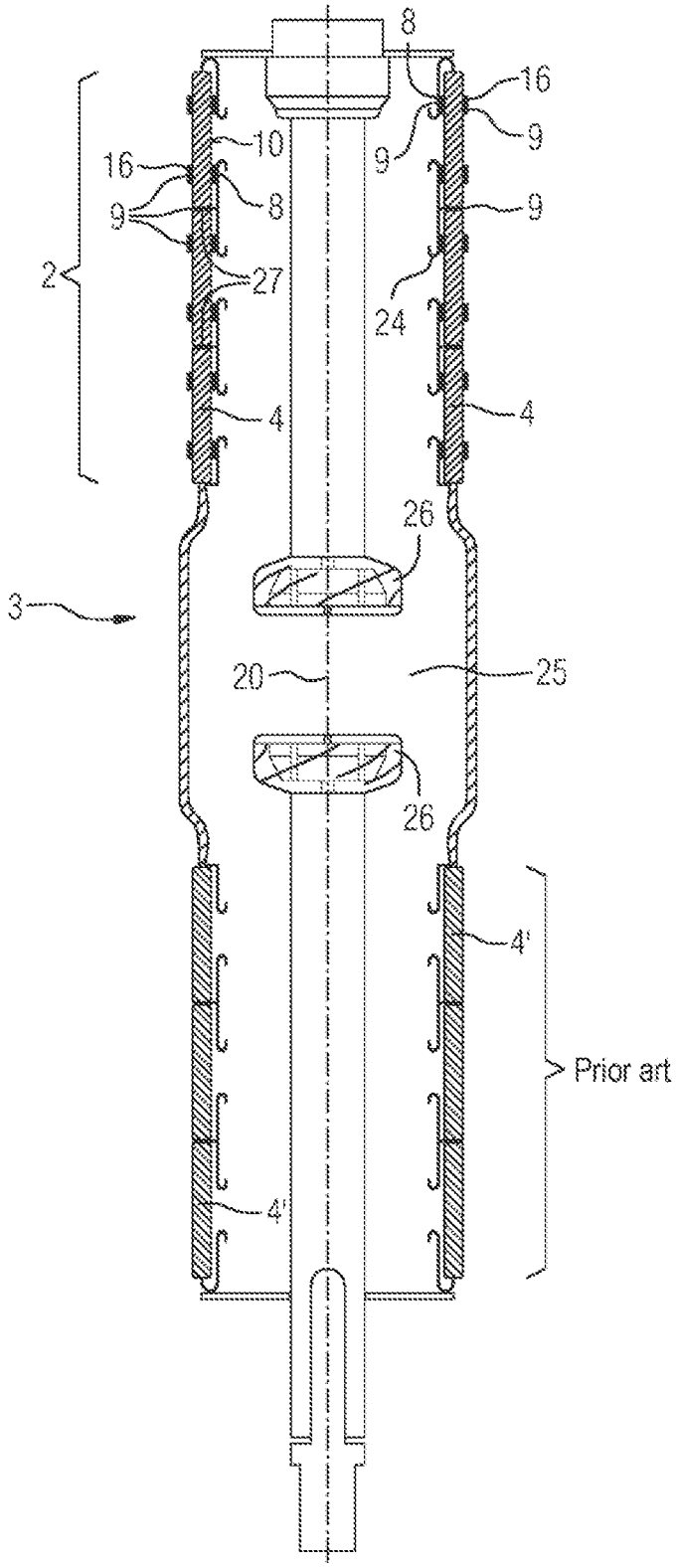
FIG. 1 shows a cross-sectional illustration of a vacuum interrupter having an insulator arrangement, wherein the left part of the vacuum interrupter represents the prior art.

In some embodiments, an insulator arrangement incorporating the teachings herein has at least one axially symmetrical insulating structure element, wherein the structure element has a conductive annular structure (8) arranged on the inner surface (6) thereof and a conductive annular structure (14) arranged on the outer surface thereof, said annular structures being insulated from one another by the insulating structure element. The annular structures described form equipotential surfaces in the region of the structure element and also in the region of the entire insulator arrangement, said equipotential surfaces increasing the overall electric strength of the insulator arrangement.

Equipotential surfaces are understood here as meaning conductive layers on the or between the structure elements, said equipotential surfaces having a higher electrical conductivity than the ceramic material of the structure elements and being arranged here perpendicularly with respect to the axis of symmetry and defining so-called equipotential faces for axial electric fields. As a result thereof, the insulator arrangement is subdivided in electrical terms into short axial pieces, as a result of which the dielectric strength of the section as well as of the entire insulator is increased.

In some embodiments, a further outer annular structure is mounted on an outer side of the structure element, said further outer annular structure having an overlap with the annular structure inside the structure element with respect to a perpendicular on the longitudinal axis of the structure element. In this way, the equipotential surfaces formed in this way are not, however, formed by conductive layers between successive structure elements, but as a region of greatly reduced axial electric field strength inside the insulator, wherein the reduction in field strength in the axial direction is facilitated by the shielding effect of the conductive coatings applied on the inside and outside.

In some embodiments, the annular structures may be mounted on the inside and on the outside at substantially the same height with respect to the axis of the structure element, that is to say that at least one perpendicular dropped onto the longitudinal axis of the structure element runs through the two annular structures. As a result thereof, the two annular structures are coupled to one another in a capacitive manner so that a region with a low axial field strength is produced radially in the structure element. In some embodiments, the inner and the outer annular structure may be arranged in a slightly offset manner with respect to the perpendicular for the purpose of expansion and for the purpose of better geometric design of the equipotential surfaces.

In some embodiments, there are at least two structure elements which are joined to one another along their end faces, wherein each of the at least two structure elements has at least one annular structure. In such embodiments, the height of the insulator arrangement increases and therefore a higher electrical breakdown strength is also achieved to a large extent when each of said structure elements comprises a further annular structure, a further increase in the breakdown field strength for the entire insulator arrangement is therefore realized.

In some embodiments, the structure element (4, 4') has an axial extent between 10 mm and 200 mm, between 20 mm and 80 mm, or even between 20 mm and 40 mm. Given an axial extent in this value range, there is an optimum with respect to the electrical breakdown strength on the one hand and the technical production possibilities of the structure element on the other hand. Structure elements can be produced in technical terms with a relatively manageable level of outlay, wherein a high breakdown strength is also realized, in particular using the described annular structures.

In some embodiments, the distance between the annular structures, both the outer and the inner annular structure, in an axial direction is between 5 mm and 40 mm. In this distance range, the effect of the equipotential surfaces is optimized depending on the provided electrical conductivity of the annular structures so that a ratio between the insulation and the discharging that can be used easily in technical terms is produced.

In some embodiments, a further coating is provided on the inner side and/or on the outer side of the structure element, said coating having a sheet resistance between $10^8$ ohms and $10^{12}$ ohms, or between $10^8$ ohms and $10^{10}$ ohms.

The annular structure itself can be designed in various forms. In some embodiments, the annular structure consists of a metallic structure or of a conductive, self-supporting structure, in particular in the form of a ring or in the form of a strip or in the form of a film applied to the corresponding surface of the structure element. In some embodiments, it may be expedient to apply the annular structure in the form of a coating, wherein all common coating methods are expedient here. In particular, so-called plasma chemical vapor deposition PCVD or CVD, but also sputtering, vapor deposition or spraying as well as knife coating and annealing in the form of screen printing may be expedient here. The conductivity or the sheet resistance at the annular structure can be set particularly well by applying a described layer.

FIG. 1 shows a cross-sectional illustration of a typical vacuum interrupter 3, wherein, as viewed from left to right, the left side of FIG. 1 corresponds to the prior art and the right side shows an example incorporating the teachings of the present disclosure. In some embodiments, the vacuum interrupter 3 comprises an insulating space 25 in which two switching contacts 26 are arranged along a longitudinal axis 20 through the vacuum interrupter 3 of substantially rotationally symmetrical design. In this case, at least one of the switching contacts 26 is arranged in the vacuum interrupter 3 so as to be able to move in a translational manner with respect to the axis 20 so that the switching contact can be opened and closed. Insulator arrangements 2 are provided in the region to the left and right of the switching contacts (in the installation position these regions are located above or below with respect to the heads of the switching contacts). Said insulator arrangement 2 consists in particular in the prior art of the connection of a plurality of structure elements 4, which are joined to one another on the end side, wherein a corresponding joining method that ensures vacuum tightness is used.

The vacuum interrupter described here differs from the prior art at least in that annular structures 8 and 16 are provided on the structure elements 4, said annular structures being arranged in the inner region. It may be expedient to mount annular structures 16 in the outer region of the structure element 4 too. The annular structures 8 and 16 are arranged so that, as seen along the axis 20, they are essentially at the same height both on the inside and the outside with respect to a longitudinal axis 20, with the result that there is at least partial overlapping. Shielding plates 24 can also be arranged on the structure elements 4 or on the insulator arrangement 2, said shielding plates preventing arcing between the contact 26 and the relatively conductive surfaces in the region of the annular structure 8. In some embodiments, both the annular structures 8 and/or 16 and the connecting regions 27, which are generally designed as conductive soldering points, serve as the equipotential surfaces already described, which act in the axial direction as zones of greatly reduced field strength and therefore prevent breakdown of the insulator arrangement 2.

Introducing the annular structure increases the internal breakdown strength of a high-voltage insulator, which is hollow-cylindrical in this case. In the case of the described vacuum interrupter, a part of the ultra-high-vacuum-tight shell of the vacuum interrupter is also enhanced at the same time by virtue of conductive structures, that is to say the annular structures 8, 16 described here, being applied to the ceramic of the structure element along the inner (vacuum-side) and outer ceramic surfaces at relatively short distances. Said annular structures 8, 16 may have a metallic or approximately metallic conductivity, which is at least three powers of ten higher than the conductivity of the adjoining surface 10 of the structure element 4. In this way, equipotential surfaces 9, which penetrate the structure element 4, in particular a ceramic body, in the radial direction, are defined by the annular structures 8, 16 with respect to the electric fields. As a result thereof, the ceramic is electrically discharged internally in short axial subregions of high axial field strengths and therefore divided in the axial direction. In this way, the dielectric strength is greatly increased not only along a section between two equipotential surfaces but also along the entire structure element 4. The described arrangement of the annular structures on the structure element produces an extended region of reduced electric field strength, in which the likelihood of breakdown is statistically minimized.

In some embodiments, ceramic structure elements 4 are primarily assumed, which are presented in the form of a hollow-cylindrical insulator structure; nevertheless, a configuration of the structure element 4 by way of insulators based on polymers or composite materials, for example glass-reinforced epoxy resin or epoxy resin filled with quartz or other ceramic powders, is likewise expedient. Cross sections different from the symmetrical circular shape, such as, for example, ellipses or polygons, are also possible solutions.

In some embodiments, the division of a conventionally long ceramic structure element 4 by applying conductive equipotential surfaces 9 in the form of the described annular structures 8, 16 in the inner and/or the outer region of the structure element 4 can either be integrated on the ceramic body as early as in the production or can be applied to said structure retrospectively. As will be explained in more detail with respect to FIG. 9 here, owing to this measure, an individual structure element with a prescribed height has a higher electric strength than the same structure element without the described conductive annular structures 8, 16. This may significantly reduce the production costs of the entire insulator arrangement, possibly according to the required insulating strength, since fewer separating points and connections 27 are required. Depending on requirements, instead of joining three structure elements to form one insulator arrangement 2, it may suffice to use just two structure elements. This saves a connection 27, which amounts to a particularly high proportion of the overall costs in the production of the insulator arrangement 2. Furthermore, a fault source in the case of a possible leak of the vacuum interrupter 3 is therefore eliminated.

The annular structure, which acts in a region inside the ceramic in a manner equivalent to an equipotential surface 9, is therefore not designed as a layer to be introduced physically, such as, for example, the connection 27, but as a zone that is functionally equal but substantially simpler to apply, said zone having a significantly increased electrical conductivity with respect to the adjoining surface 10 of the structure element 4. In this case, a plurality of regions with the annular structures can be formed along a structure element in the axial direction (along the longitudinal axis) in order to further shorten the insulator partial lengths subjected to high electric field strengths without impairing the electric strength at the surface of the insulator body in the axial direction.

The described annular structures can be produced by different methods and forms. For example, the application of the annular structures 8, 16 by way of a metallic conductive layer, for example in the form of annealed metallic or metal-oxide layers, is expedient. Suitable metal oxides or mixtures are, inter alia, those that are also used for metallization of ceramics, for example according to the so-called Mo/MnO method, or those used for the reactive soldering connection of metallic and ceramic components.

The application of discontinuous annular structures, both annular structures 16 and annular structures 8, which, in the form of discontinuous strips, have, for example, offset strips or rings or points that adjoin one another but do not touch, is particularly suitable, in particular with respect to the outer annular structures 18.

Layers that can be configured by way of sputtering, vapor deposition, spraying or CVD or PCVD methods as metallic layers, metal-oxide layers or also as metal borides, carbides or metal nitrides are likewise possible. It is likewise possible to apply organically bonded, conductive lacquers, which are freed of the organic phase by way of thermal treatment. Graphitic or graphite-containing layers, for example according to the Aquadag method, are also suitable for representing the corresponding annular structures. This likewise applies for graphite structures generated by appropriate abrasion of a carbon source/graphite source. The described method is an exemplary departure from possible forms of representing the described annular structures 8 and 16.

Figure 7:
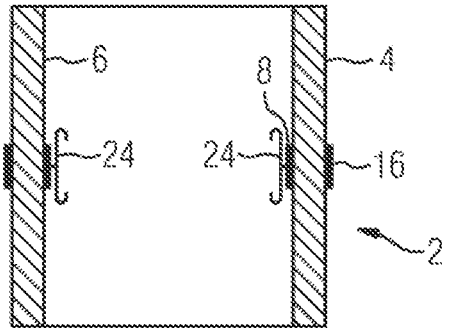
FIG. 7 shows a structure element analogous to the illustration in FIG. 2 in a cross-sectional illustration having shielding plates in the inner region.

In some embodiments, the corresponding annular structures 8, 16 can be provided on the structure elements 4, in the arrangement thereof in the insulator arrangement 2 with the so-called shielding systems or shielding plates 24, as is illustrated by way of example in FIG. 7 but also in FIG. 1. This results in an additional function, which can consist, for example, in the fact that said shielding plates 27 constitute a shielding of the ceramic surface from vapor deposition with metal vapor, which results from the switching arcs.

The annular structures 8, 16 are not necessarily continuous, that is to say uninterrupted, but can also be embodied as planar formations consisting of closely adjacent, conductive structures applied in a grid-like manner, for example points or dashes. Such layers can be produced particularly advantageously by means of screen printing methods such as knife coating.

Figure 2:
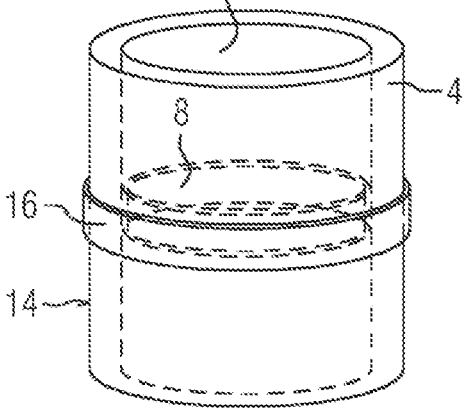
FIG. 2 shows a three-dimensional illustration of a structure element having a respective annular structure on the inside and the outside.
Figure 3:
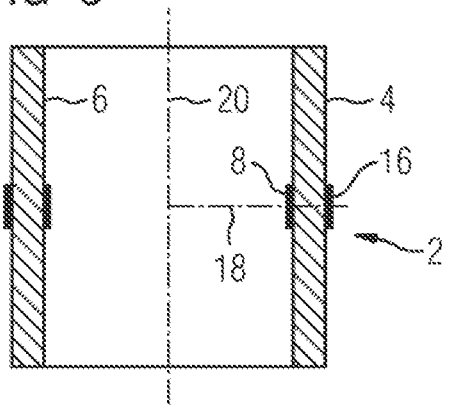
FIG. 3 shows a cross-sectional illustration of the structure element from FIG. 2, FIG. 4 likewise shows a cross-sectional illustration of the structure element from FIG. 2 having an offset arrangement of the annular structures, FIG. 5 likewise shows cross-sectional illustrations of the structure element from FIG. 2 having an additional two annular structures on the outside.

FIG. 2 shows a three-dimensional illustration of a structure element 4, which is illustrated as substantially rotationally symmetrical, in this case in a cylindrical shape, and which has an annular structure 8 on an inner surface 6, said annular structure being illustrated using dashes and an outer annular structure 16 being arranged on an outer side in FIG. 2. As can be seen in FIG. 3, which illustrates a cross-sectional illustration of FIG. 2, the annular structure 16 and 8 run at the same height with respect to an axial extent of the structure element 4. This means a perpendicular 18 that drops onto the axis 20 passes through both the inner annular structure 8 and the outer annular structure 16 and does this at least in an overlap region.

Figure 4:
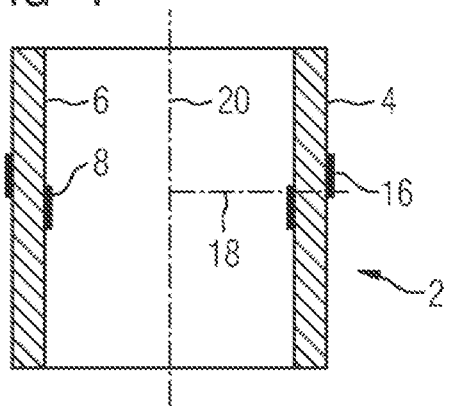
Figure 5:
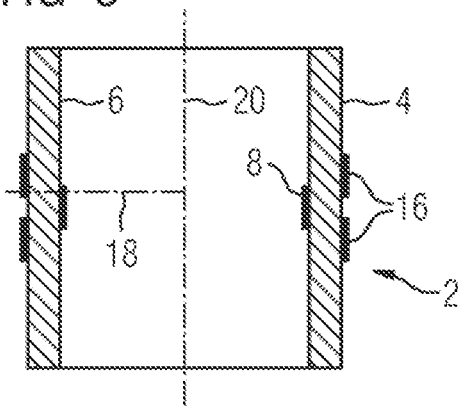

FIGS. 4 and 5 illustrate annular structures 8 and 16, in which there is not a 100% overlap in the axial direction, wherein said annular structures 8 and 16 are slightly displaced with respect to one another axially, but there continues to be an overlap region. In FIG. 5, two annular structures 16 are applied to the outer side of the structure element 4, wherein the two annular structures 16 preferably again have an overlap region in the axial direction with the annular structure 8 in the inner region 6 of the structure element 4. That is to say a perpendicular 18 can be placed on the axis 20 so that it runs through both annular structures 8, 16.

Figure 6:
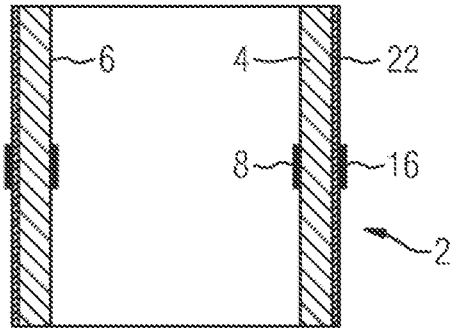
FIG. 6 shows a structure element having annular structures and a surface coating of an outer surface.

FIG. 6 illustrates a structure element 4, which has an analogous embodiment to the structure element 4 in FIG. 3 but which has an additional surface coating 22 on the outer surface thereof, which coating may have a sheet resistance of typically 100 megaohms per square, which constitutes a poor conductor or, in other words, not an insulator. In this way, both an ohmic and non-linear current/voltage characteristic curve acts on said surface 22. This serves for electric field control on the surface and for reducing the charging of the surface with electric charges. This can produce substantially surge-proof structure elements 4. In some embodiments, the conductive coating with a high sheet resistance of between $10^8$ ohms and $10^{12}$ ohms can also be applied to the inner side or to both sides of the ceramic. The resistance layer can be applied both below the annular structures 8, 16 and, in another embodiment, extend in an overlapping manner over the annular structures 8, 16.

FIGS. 2 to 7 illustrate insulator arrangements 2 each consisting of just one structure element 4. In these exemplary embodiments, said insulator arrangements 2 are designed with annular structures 8, 16 only in the central region here for the sake of clarity. However, the annular structures 8, 16 have a typical spacing in the axial direction between 10 mm and 40 mm. A typical structure element 4, as is illustrated in FIGS. 2-7, can thus have a plurality of annular structures 8 and 16 on the inner and the outer side that lead to the advantageous effects in terms of inner electrics already described. In this respect, FIGS. 2-7 have a purely exemplary nature and serve, in particular, to illustrate the arrangement of the annular structures 8 and 16 in general.

Figure 8:
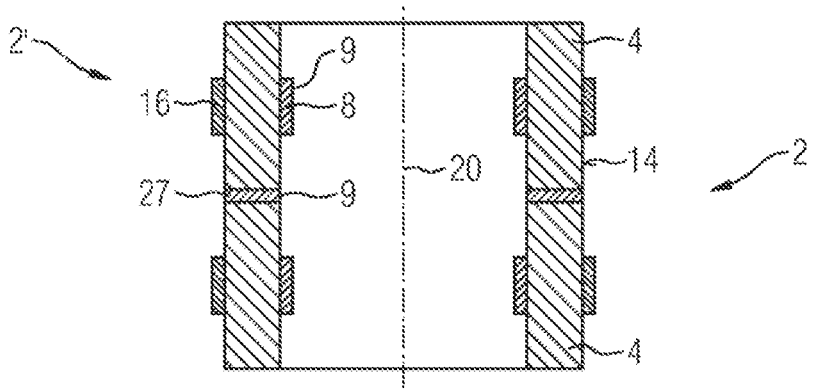
FIG. 8 shows a cross section through an insulator arrangement having two structure elements joined to one another and FIG. 9 shows a graph of the correlation between the breakdown field strength and the height or thickness of the insulator material of the structure element.

FIG. 8 shows an insulator arrangement 2 that is composed of two structure elements 4. The structure elements 4 in FIG. 8 are joined to one another at the end face by the connection 27. In this case, the connection 27 likewise consists of a metallic conductive layer and likewise constitutes an equipotential surface 9. By applying the annular structures 8 and 16, additional equipotential surfaces 9 having the positive electrical properties already described are introduced into the insulator structure 2.

Figure 9:
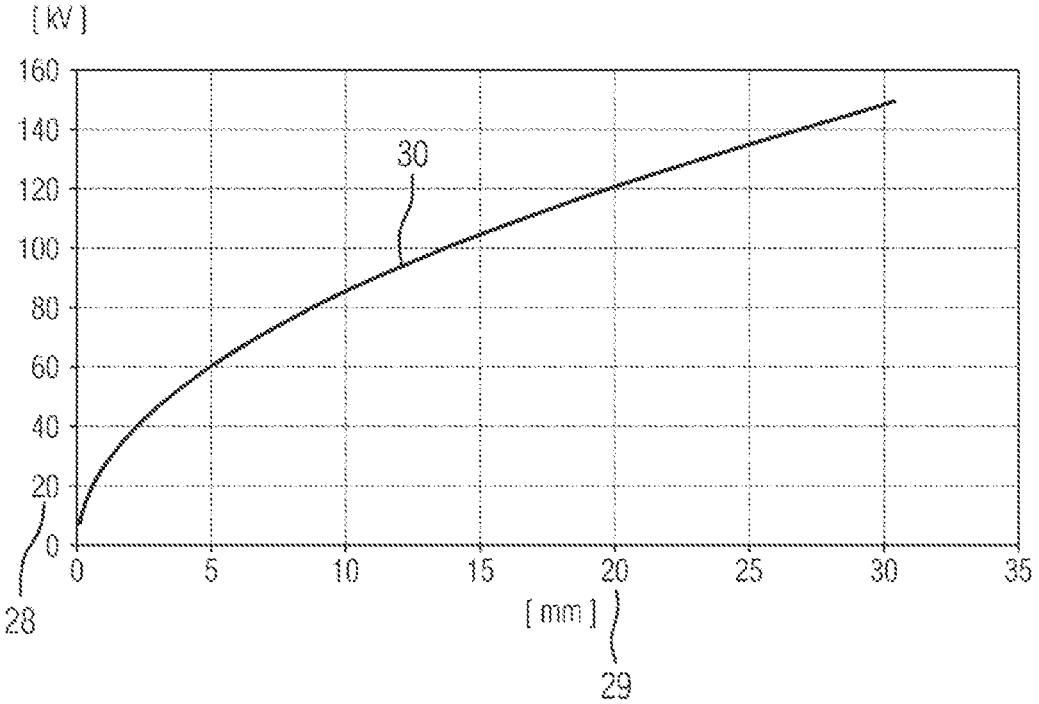

Regarding FIG. 9, in the case of a correlation between the breakdown field strength 28 plotted on the Y axis and the height or thickness of the ceramic insulating body plotted on the X axis and provided with the reference sign 29, a root-shaped profile is produced, which is represented by the curve 30. That is to say, given a structure element 4 with a height of, for example, 5 units of length, a breakdown strength, in this example of 60 kV, is achieved here. Given 10 units of length of the same material and the same thickness, only approximately 90 kV breakdown strength is achieved here. That is to say that either the structure element 4 has to be designed to be very long in order to achieve a high breakdown strength or that a plurality of structure elements 4 each having the appropriate equipotential surfaces 9 have to be joined to one another. The equipotential surfaces 9 are in this case illustrated in the conventional design of vacuum interrupters 3 or insulator arrangements 2 for vacuum interrupters by the solder connections.

The additional annular structures 8 and 16 described here on the one hand cause shortening of the distances between the equipotential surfaces 9, such that, for example, the breakdown strength of 60 kV can be achieved given a spacing of 5 units of length between the annular structures. On the other hand, a virtual equipotential surface 9' is inserted in the ceramic region between the annular structures 8, 16, which causes a virtual shortening of the ceramic without a soldering connection. Given 2×5 units of length along the same structure element, even a breakdown strength of 120 kV can be achieved, wherein a conventional structure element according to the prior art would achieve only 90 kV breakdown strength according to the same example. This causes the entire length of the insulator arrangement 2 to be significantly reduced, which on the one hand illustrates a significant reduction in the production process outlay, which in turn is reflected in a significant reduction in cost with a smaller installation space of the vacuum interrupter 3.

What is claimed is:

1. An insulator arrangement for a switchgear assembly, the arrangement comprising:

an axially symmetrical insulating structural element;

a first conductive annular structure arranged on an inner surface of the insulating structural element; and a second conductive annular structure arranged on an outer surface of the insulating structural element;

wherein the first conductive annular structure and the second conductive annular structure are insulated from one another by the insulating structural element; and wherein the insulating structural element has an axial length between 10 mm and 200 mm.

2. The insulator arrangement as claimed in claim 1, wherein each of the first conductive annular structure and the second conductive annular structure has an electrical conductivity at least eight powers of ten higher than an electrical conductivity of an adjoining surface of the insulating structural element.

3. The insulator arrangement as claimed in claim 1, wherein the first conductive annular structure has an axial length at least half and at most four times a radial thickness of the insulating structural element.

4. The insulator arrangement as claimed in claim 1, wherein each of the first conductive annular structure and the second conductive is mounted with respect to one another with an overlap with respect to a perpendicular on a longitudinal axis of the insulating structural element.

5. The insulator arrangement as claimed in claim 1, further comprising a second insulating structural element including at least one additional conductive annular structure arranged on at least one of an inner surface or an outer surface of the second insulating structural element; and wherein the insulating structural element and the second insulating structural element are joined to one another at end faces of the insulating structural element and second insulating structural element.

6. The insulator arrangement as claimed in claim 1, wherein a distance between the first and second conductive annular structures in an axial direction is between 5 mm and 40 mm.

7. The insulator arrangement as claimed in claim 1, further comprising a coating applied to at least one of the inner surface and the outer surface of the insulating structural element;

wherein the coating has a sheet resistance between 108 ohms and 1012 ohms.

8. The insulator arrangement as claimed in claim 1, wherein at least one of the first conductive annular structure or the second conductive annular structure comprises a metallic structure having a shape of a ring or a strip.

9. The insulator arrangement as claimed in claim 1, wherein at least one of the first conductive annular structure or the second conductive annular structure comprises a conductive coating.

10. A vacuum interrupter for high-voltage or medium-voltage applications, the vacuum interrupter comprising:

at least one insulator arrangement for a switchgear assembly, each insulator arrangement having:

an axially symmetrical insulating structural element;

a first conductive annular structure arranged on an inner surface of the insulating structural element; and a second conductive annular structure arranged on an outer surface of the insulating structural element;

wherein the first conductive annular structure and the second conductive annular structure are insulated from one another by the insulating structural element; and wherein a distance between the first and second conductive annular structures in the axial direction is between 5 mm and 40 mm.

11. The vacuum interrupter of claim 10, wherein for each insulator arrangement, the insulating structural element has an axial length between 10 mm and 200 mm.

12. The vacuum interrupter of claim 10, wherein for each insulator arrangement, the first conductive annular structure has an axial length of at least half and at most four times a radial thickness of the insulating structural element.

13. The vacuum interrupter of claim 10, wherein for each insulator arrangement, each of the first conductive annular structure and the second conductive annular structure has an electrical conductivity at least eight powers of ten higher than an electrical conductivity of an adjoining surface of the insulating structural element.

14. The vacuum interrupter of claim 10, wherein for each insulator arrangement, each of the first conductive annular structure and the second conductive is mounted with respect to one another with an overlap with respect to a perpendicular on a longitudinal axis of the insulating structural element.

15. The vacuum interrupter of claim 10, wherein for each insulator arrangement:

the insulator arrangement further comprises a second insulating structural element including at least one additional conductive annular structure arranged on at least one of an inner surface or an outer surface of the second insulating structural element; and wherein the insulating structural element and the second insulating structural element are joined to one another at end faces of the insulating structural element and second insulating structural element.

16. An insulator arrangement for a switchgear assembly, the arrangement comprising:

an axially symmetrical insulating structural element;

a first conductive annular structure arranged on an inner surface of the insulating structural element; and a second conductive annular structure arranged on an outer surface of the insulating structural element;

wherein the first conductive annular structure and the second conductive annular structure are insulated from one another by the insulating structural element; and wherein the first conductive annular structure has an axial length at least half and at most four times a radial thickness of the insulating structural element.

17. The insulator arrangement of claim 16, wherein for each insulator arrangement, the insulating structural element has an axial length between 10 mm and 200 mm.

18. The insulator arrangement of claim 16, wherein a distance between the first and second conductive annular structures in an axial direction is between 5 mm and 40 mm.

19. The insulator arrangement of claim 16, wherein each of the first conductive annular structure and the second conductive annular structure has an electrical conductivity at least eight powers of ten higher than an electrical conductivity of an adjoining surface of the insulating structural element.

20. The insulator arrangement of claim 16, further comprising a second insulating structural element including at least one additional conductive annular structure arranged on at least one of an inner surface or an outer surface of the second insulating structural element; and wherein the insulating structural element and the second insulating structural element are joined to one another at end faces of the insulating structural element and second insulating structural element.

* * * * *